US010703109B2

(12) United States Patent
Yamagishi

(10) Patent No.: US 10,703,109 B2
(45) Date of Patent: Jul. 7, 2020

(54) LIQUID DISCHARGE APPARATUS AND FILTER UNIT

(71) Applicant: SEIKO EPSON CORPORATION, Tokyo (JP)

(72) Inventor: Ken Yamagishi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/252,449

(22) Filed: Jan. 18, 2019

(65) Prior Publication Data

US 2019/0224981 A1 Jul. 25, 2019

(30) Foreign Application Priority Data

Jan. 22, 2018 (JP) ..... 2018-008095

(51) Int. Cl.
*B41J 2/175* (2006.01)
*B41J 2/19* (2006.01)
*B41J 2/14* (2006.01)

(52) U.S. Cl.
CPC ..... *B41J 2/17563* (2013.01); *B41J 2/17596* (2013.01); *B41J 2/19* (2013.01); *B41J 2002/14403* (2013.01)

(58) Field of Classification Search
CPC ..... B41J 2/17513; B41J 2/17563; B41J 2/19; B41J 2002/14403
See application file for complete search history.

(56) References Cited

U.S. PATENT DOCUMENTS 6,000,789 A * 12/1999 Takagi ..... B41J 2/17513 347/86
6,007,191 A * 12/1999 Fujii ..... B41J 2/17513 347/87
6,120,140 A * 9/2000 Hirosawa ..... B41J 2/17563 347/93
6,196,671 B1 * 3/2001 Breemes, Sr. ..... B41J 2/17503 347/86
6,685,307 B2 * 2/2004 Dowell ..... B41J 2/17556 347/85
7,111,932 B2 * 9/2006 Steed ..... B41J 2/14145 347/92

(Continued)

FOREIGN PATENT DOCUMENTS

JP 09-277552 A 10/1997
JP 2000-177144 A 6/2000

(Continued)

*Primary Examiner* — John Zimmermann
(74) *Attorney, Agent, or Firm* — Workman Nydegger

(57) ABSTRACT

A filter unit has a filter chamber disposed in a channel through which liquid is to be supplied to a liquid discharge unit. The filter unit has a filter and a partition. The filter is disposed in the filter chamber, inclined relative to a horizontal direction. The filter separates the filter chamber into an upstream chamber the liquid to be supplied and a downstream chamber in communication with the liquid discharge unit. The partition has a wall surface facing the filter. The partition separates the upstream chamber into a first chamber the liquid to be supplied to and a second chamber adjacent to the filter. The filter unit has, in an upper portion of the partition, an opening that allows communication between the first chamber and the second chamber.

20 Claims, 17 Drawing Sheets

(56) References Cited

U.S. PATENT DOCUMENTS

| | | | | |
|---|---|---|---|---|
| 7,517,067 | B2 * | 4/2009 | Inoue | B41J 2/175 347/85 |
| 7,556,362 | B2 * | 7/2009 | Akahane | B41J 2/17596 347/40 |
| 8,439,481 | B2 * | 5/2013 | Xie | B41J 2/14016 137/337 |
| 2002/0109760 | A1 * | 8/2002 | Miyazawa | B41J 2/17503 347/86 |
| 2005/0078157 | A1 | 4/2005 | Suzuki | |
| 2008/0158323 | A1 * | 7/2008 | Nishizaki | B41J 2/14209 347/93 |
| 2010/0201759 | A1 * | 8/2010 | Kawase | B41J 2/16532 347/85 |
| 2010/0289856 | A1 * | 11/2010 | Yamamoto | B41J 2/17509 347/85 |
| 2011/0277303 | A1 * | 11/2011 | Mallory | B41J 2/175 29/447 |
| 2014/0146112 | A1 * | 5/2014 | Murray | B41J 2/17563 347/85 |
| 2016/0332443 | A1 | 11/2016 | Kanegae | |

FOREIGN PATENT DOCUMENTS

| | | | |
|---|---|---|---|
| JP | 2005-074836 | A | 3/2005 |
| JP | 2011-206959 | A | 10/2011 |
| JP | 2016-215420 | A | 12/2016 |

* cited by examiner

LIQUID DISCHARGE APPARATUS AND FILTER UNIT

BACKGROUND

1. Technical Field

The present invention relates to a technique for discharging liquid such as ink.

2. Related Art

A liquid discharge apparatus that discharges liquid such as ink from nozzles has a filter chamber disposed partway along a liquid channel through which the liquid flows. A filter that removes a bubble or foreign matter mixed into the liquid is disposed in the filter chamber. For example, a filter disclosed in JP-A-2016-215420 is provided so as to separate an upstream chamber (liquid storage portion) and a downstream chamber (second connection channel) of a filter chamber off from each other. With this structure, a bubble having entered the filter chamber first enters the upstream chamber and is stored in the upstream chamber. This can suppress flowing of the bubble downstream through the filter.

However, with the structure as disclosed in JP-A-2016-215420, in which the filter chamber is separated into the upstream chamber and the downstream chamber by the filter, growth of a bubble having entered the upstream chamber may bring the bubble into contact with the filter, thereby closing the filter. Even in such a case, when the volume of the upstream chamber is increased, a large bubble may be able to be stored while reducing the contact of the bubble with the filter. However, as the volume of the upstream chamber is increased, flow of the liquid pushing the bubble downstream of the filter is required more for discharging the bubble. This reduces the performance for discharging the bubble.

SUMMARY

An advantage of some aspects of the invention is to improve performance for discharging a bubble while suppressing closing of a filter with the bubble having entered a filter chamber.

A filter unit according to a first aspect of the invention has a filter chamber disposed partway along a channel through which liquid is supplied to a liquid discharge unit. The filter unit includes a filter and a partition. The filter is disposed in the filter chamber such that the filter is inclined relative to a horizontal direction. The filter separates the filter chamber into an upstream chamber to which the liquid is supplied and a downstream chamber which communicates with the liquid discharge unit. The partition has a wall surface which faces the filter. The partition separates the upstream chamber into a first chamber to which the liquid is supplied and a second chamber which faces the filter. The filter unit has, in an upper portion of the partition, an opening that allows communication between the first chamber and the second chamber. According to the above-described form, the partition is provided. The partition has the wall surface facing the filter inclined relative to the horizontal direction. The partition separates the upstream chamber into the first chamber to which the liquid is supplied and a second chamber facing the filter. This regulates movement of the bubble to the second chamber by using the partition even when the bubble having entered the first chamber grows. Thus, contact of the bubble with the filter can be avoided. In this way, closing of the filter with the bubble having entered the filter chamber can be suppressed. Furthermore, since the bubble is moved upward due to a buoyant force, the bubble is likely to grow in the upper portion of the first chamber. Meanwhile, according to this form, the opening that allows communication between the first chamber and the second chamber is provided in the upper portion of the partition. Thus, when discharging the bubble, the bubble stored in the upper portion of the first chamber is likely to move to the second chamber through the opening. Accordingly, the bubble discharging performance can be improved. Thus, according to this form, the bubble discharging performance can be improved while closing of the filter with the bubble having entered the filter chamber can be suppressed.

It is preferable that the opening of the partition be disposed above a virtual horizontal plane passing through an upper end of the filter. According to the above-described form, even when the bubble stored above the virtual horizontal plane in the first chamber grows and becomes closer to the opening, contact of the bubble with the filter can be suppressed because the filter is disposed below the bubble.

It is preferable that the partition have at least one communication hole that allows communication between the first chamber and the second chamber. In this case, the at least one communication hole is disposed below the opening and has a smaller opening area than that of the opening. According to the above-described form, the partition has the at least one communication hole that allows communication between the first chamber and the second chamber. The at least one communication hole is disposed below the opening. Thus, even when the bubble in the first chamber grows to such a degree that the bubble closes the opening, the liquid having been supplied to the first chamber can move to the second chamber through the at least one communication hole. Thus, the liquid can be supplied to the liquid discharge unit. Furthermore, since the at least one communication hole has the smaller opening area than that of the opening, the bubble having grown in the first chamber cannot pass through the at least one communication hole. Thus, the movement of the bubble to the second chamber can be suppressed.

It is preferable that the at least one communication hole be disposed below a virtual horizontal plane passing through an upper end of the filter. According to the above-described form, even when the bubble grows above the virtual horizontal plane in the first chamber, the at least one communication hole exists below the bubble. Thus, the bubble cannot pass through the at least one communication hole, and accordingly, contact of the bubble with the filter can be suppressed.

It is preferable that the at least one communication hole include a plurality of communication holes. In this case, at least one of the plurality of communication holes is disposed below a central position of the partition in a vertical direction. According to the above-described form, at least one of the plurality of communication holes is disposed below the central position of the partition in the vertical direction. Thus, a flow of the liquid passing through the at least one of the plurality of communication holes is generated below the vertically central position of the partition in the first chamber. This can suppress stagnation of the liquid in a vertically lower portion of the first chamber.

It is preferable that the filter unit further include a plurality of ribs that project at least in a vertical direction at a lower edge portion of the opening of the partition. In this case, the plurality of ribs are space from one another in a direction intersecting the vertical direction. According to the above-described form, even when the bubble grows and becomes closer to the opening in the first chamber, the bubble is pressed upward by upper ends of the ribs. Thus, the liquid supplied to the first chamber can move into the second chamber through gaps between the ribs, and accordingly, the liquid can be supplied to the liquid discharge unit.

It is preferable that a portion of the first chamber disposed above a virtual horizontal plane passing through an upper end of the filter be larger than or equal to 50% of an entirety of the upstream chamber in volume. According to the above-described form, when the liquid is sucked from the filter unit during refilling with the liquid, air in the first chamber expands due to pressure reduction. Part of the expanding air moves beyond the virtual horizontal plane, displaces the liquid in the second chamber, and is discharged further in the downstream direction than the filter. The displaced air contracts due to refilling of the filter unit with the liquid again. Most of the air having contracted can be contained within the portion of the upstream chamber above the virtual horizontal plane passing through the upper end of the filter. Thus, even when the air (bubble) remains in the upstream chamber during refilling with the liquid, the filter is not closed by the remaining air, and accordingly, the liquid can be supplied to the liquid discharge unit.

It is preferable that part of the first chamber be superposed on the filter in a vertical direction. According to the above-described form, the part of the first chamber is superposed on the filter in the vertical direction. Thus, the size of the filter unit can be reduced in a direction intersecting the vertical direction.

It is preferable that the first chamber extend further upward than the filter. According to the above-described form, the first chamber extends further upward than the filter. Thus, the volume of the first chamber can be increased above the filter. Accordingly, the amount of bubbles able to be stored in the first chamber can be increased.

It is preferable that the wall surface of the partition facing the filter be inclined relative to the filter such that a distance between the wall surface and the filter increases toward the opening. According to the above-described form, when the filter unit is inclined such that the filter is horizontally disposed, the bubble in the second chamber can be guided to the opening along the wall surface of the partition due to the buoyant force. Thus, the bubble in the second chamber can be easily moved to the first chamber through the opening.

It is preferable that the partition be a plate-shaped member disposed on a substrate to which the filter is secured. According to the above-described form, the partition is a plate-shaped member disposed on the substrate to which the filter is secured. Thus, the distance between the filter and the wall surface of the partition can be adjusted depending on the thickness of the substrate to which the filter is secured. This increases ease of adjusting the volume of the second chamber between the filter and the wall surface of the partition.

A filter unit according to a second aspect of the invention has a filter chamber disposed partway along a channel through which liquid is supplied to a liquid discharge unit. The filter unit includes a filter and a partition. The filter is disposed in the filter chamber such that the filter is inclined relative to a horizontal direction. The filter separates the filter chamber into an upstream chamber to which the liquid is supplied and a downstream chamber which communicates with the liquid discharge unit. The partition has a wall surface which faces the filter. The partition separates the upstream chamber into a first chamber to which the liquid is supplied and a second chamber which faces the filter. The filter unit has, in an upper portion of the partition, an opening that allows communication between the first chamber and the second chamber. Part of the first chamber is superposed on the filter in a vertical direction. According to the above-described form, the bubble discharging performance can be improved while closing of the filter with the bubble having entered the filter chamber can be suppressed. Since the part of the first chamber is superposed on the filter in the vertical direction, the size of the filter unit can be reduced in the direction intersecting the vertical direction.

A liquid discharge apparatus according to a third aspect of the invention includes the filter unit according to any one of the above-described forms and the liquid discharge unit that includes a nozzle which discharges the liquid supplied to the liquid discharge unit through the filter unit. According to the above-described form, there can be provided the liquid discharge apparatus including the filter unit with which the bubble discharging performance can be improved while closing of the filter with the bubble having entered the filter chamber can be suppressed.

It is preferable that, in the liquid discharge apparatus, two of the filter unit be arranged, the two filter units each have an inlet through which the liquid is supplied thereto, and an extension channel be provided so as to extend the inlet of one of the two filter units toward the inlet of another of the filter units. According to the above-described form, the extension channel is provided so as to extend the inlet of one of the two filter units toward the inlet of the other of the filter units. In this way, the distance between the inlets can be reduced. Thus, for example, the size of a component to be disposed upstream of each inlet can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
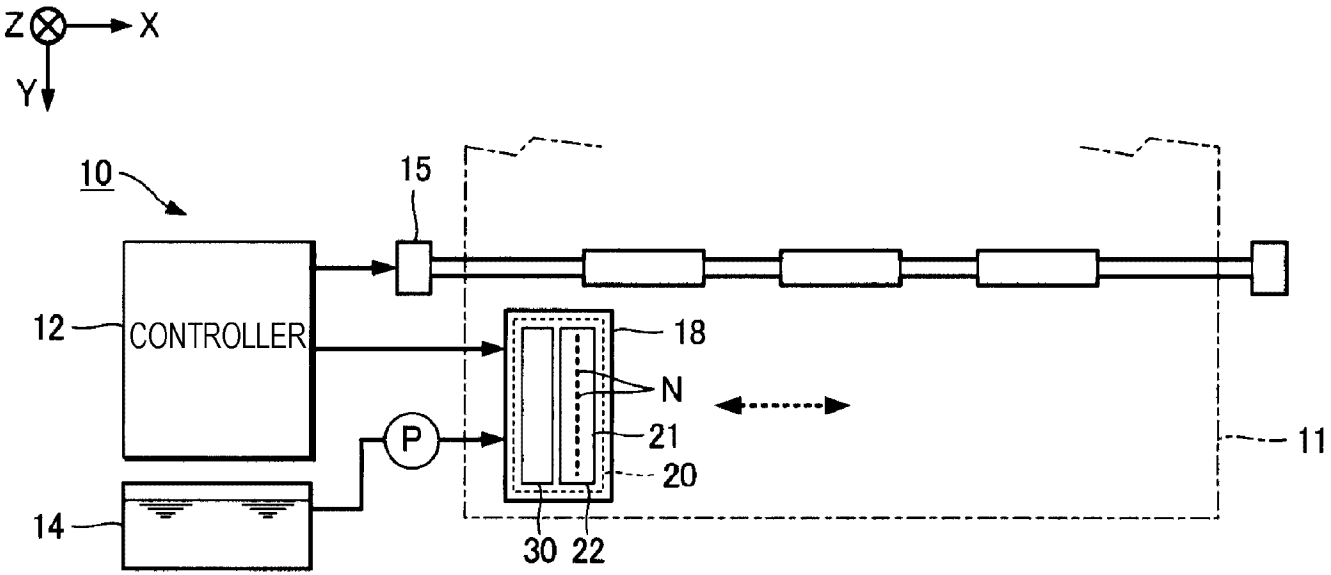
FIG. 1 is a configuration view of a liquid discharge apparatus according to an embodiment of the invention.

FIG. 1 is a configuration view of part of a liquid discharge apparatus 10 according to an embodiment of the invention. The liquid discharge apparatus 10 according to the present embodiment is an ink jet printer in which ink as an example of liquid is discharged to a medium 11 such as printing paper. The liquid discharge apparatus 10 illustrated in FIG. 1 includes a controller 12, a transport mechanism 15, a liquid discharge head 20, and a carriage 18. A liquid container 14 (cartridge) that stores the ink therein is mounted on the liquid discharge apparatus 10.

The liquid container 14 is a cartridge of an ink tank type that includes a box-shaped container detachably attached to a main body of the liquid discharge apparatus 10. The liquid container 14 is not limited to a box-shaped container. The liquid container 14 may be a cartridge of an ink pack type that includes a bag-shaped container. The ink is stored in the liquid container 14. The ink may be black ink or color ink. The ink stored in the liquid container 14 is to be supplied (pumped) to the liquid discharge head 20 by a pump P.

The controller 12 performs centralized control on the elements of the liquid discharge apparatus 10. The transport mechanism 15 transports the medium 11 in the Y direction under the control of the controller 12. The liquid discharge head 20 discharges the ink to the medium 11 from a plurality of nozzles N under the control of the controller 12. The liquid discharge head 20 includes a liquid discharge unit 22 and a filter unit 30.

The liquid discharge unit 22 is disposed in the X direction perpendicular to the Y direction that is a direction in which the medium 11 is transported. A nozzle row is disposed in the liquid discharge unit 22. The nozzle row is a cluster of a plurality of nozzles N arranged along a straight line in the Y direction. In the liquid discharge unit 22, the plurality of nozzles N are formed in a discharge surface 21 facing the medium 11. The number of liquid discharge units 22 or the number of nozzle rows is not limited to that in the drawing. The liquid discharge unit 22 includes a plurality of combinations of pressure chambers and piezoelectric elements (not illustrated) corresponding to different nozzles N. Supplying a drive signal causes the piezoelectric elements to vibrate, thereby varying the pressure in the pressure chambers. Thus, the ink with which the pressure chambers are filled is discharged from the nozzles N.

The liquid discharge head 20 is mounted on the carriage 18. The controller 12 causes the carriage 18 to reciprocate in the X direction intersecting the Y direction. Along with the transportation of the medium 11 performed by the transport mechanism 15 and the repeated reciprocation of the carriage 18, the liquid discharge head 20 discharges the ink to the medium 11. Thus, a desired image is formed on the surface of the medium 11. For example, it is possible to mount on the carriage 18 a plurality of different liquid discharge heads 20 discharging different types of ink. A direction perpendicular to the X-Y plane (plane parallel to the surface of the medium 11) (the vertical direction) is referred to as the Z direction.

The filter unit 30 functions as a filter device in which a filter that traps a bubble and foreign matter mixed with the ink in a channel is disposed. The filter unit 30 is provided in a channel of the ink supplied from the liquid container 14.

Figure 2:
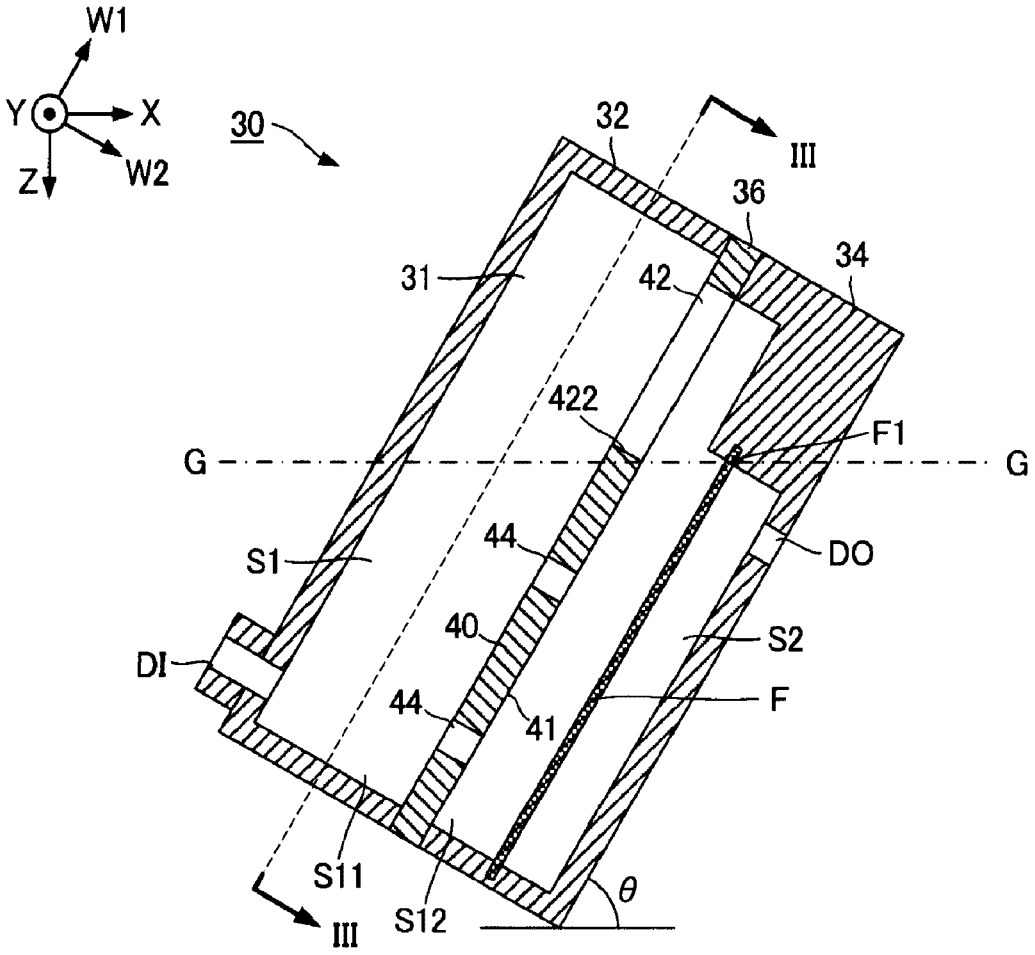
FIG. 2 is a sectional view of a filter unit according to the present embodiment.
Figure 3:
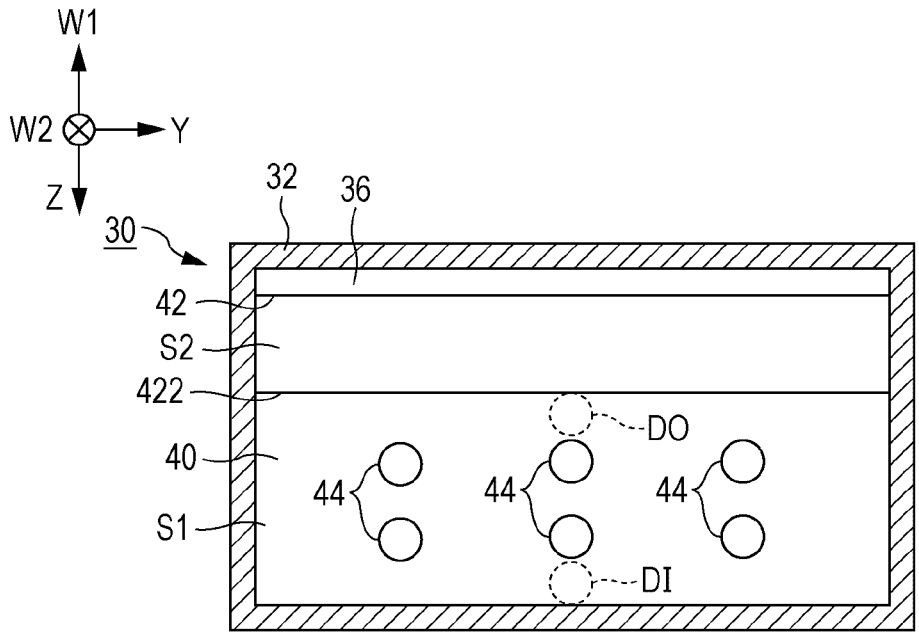
FIG. 3 is a sectional view taken along line III-III illustrated in FIG. 2.

FIGS. 2 and 3 illustrate a specific structure of the filter unit 30 according to the present embodiment. FIG. 2 is a sectional view taken along a plane (perpendicularly) intersecting a filter F. FIG. 3 is a sectional view taken along line III-III illustrated in FIG. 2. The filter unit 30 according to the present embodiment is inclined relative to the horizontal direction. Although an inclination angle θ relative to the horizontal direction may be any angle between 0 to 90 degrees, an example in which the inclination angle is 60 degrees is described according to the present embodiment. In FIG. 2, a direction in which the filter unit 30 is inclined (a direction in which the inclination angle θ is 60 degrees relative to the horizontal direction) is referred to as W1 and a direction perpendicular to a W1-Y plane is referred to as W2.

As illustrated in FIG. 2, the filter unit 30 has a filter chamber 31 that communicates with the channel of the ink. The filter chamber 31 and the filter F are disposed so as to extend in the W1 direction. The filter F is disposed in the filter chamber 31 so as to separate the filter chamber 31 into an upstream chamber S1 and a downstream chamber S2. The upstream chamber S1 is a space upstream of the filter F. The ink from the liquid container 14 is supplied to the upstream chamber S1 through an inlet DI.

The downstream chamber S2 is a space downstream of the filter F and communicates with the liquid discharge unit 22 through an outlet DO. The ink from the liquid container 14 is supplied to the upstream chamber S1 through the inlet DI, passes through the filter F and moves to the downstream chamber S2, and is discharged from the outlet DO so as to be supplied to the liquid discharge unit 22.

A partition 40 is provided in the upstream chamber S1 according to the present embodiment. The partition 40 has a wall surface 41 facing the filter F and separates the upstream chamber S1 into a first chamber S11 (bubble chamber) to which the ink is supplied and a second chamber S12 facing the filter F. The partition 40 according to the present embodiment includes a plate-shaped member 36. The plate-shaped member 36 is disposed between an upstream substrate 32 and a downstream substrate 34. The upstream substrate 32 defines the upstream chamber S1. The filter F is secured to the downstream substrate 34 that defines the second chamber S12 and the downstream chamber S2.

An opening 42 that allows communication between the first chamber S11 and the second chamber S12 is provided in an upper portion (vertically upper portion) of the partition 40. As illustrated in FIG. 3, the opening 42 according to the present embodiment is provided in an upper portion of the partition 40 in the W1 direction and extends in the Y direction. The opening 42 of the partition 40 is disposed above a virtual horizontal plane G-G passing through an upper end F1 of the filter F. According to the present embodiment, the upper end F1 of the filter F is an upper end in a range of an effective area of the filter F. For example, in the filter F illustrated in FIG. 2, the range of the effective area of the filter F is a range interposed between the second chamber S12 and the downstream chamber S2, and an upper end portion of the range of the effective area of the filter F is the upper end F1 of the filter F. In the case where, as illustrated in FIG. 2, end portions (edge portions) of the filter F are inserted into the downstream substrate 34 and joined to the downstream substrate 34 by welding or bonding, the joining portions (portions inserted into the downstream substrate 34) are not included in the range of the effective area of the filter F.

As illustrated in FIGS. 2 and 3, the partition 40 has a plurality of communication holes 44 that allow communication between the first chamber S11 and the second chamber S12. However, a single communication hole 44 may be provided. Each of the communication holes 44 is disposed below the opening 42 and has a smaller opening area than that of the opening 42. The communication holes 44 according to the present embodiment are disposed below the virtual horizontal plane G-G passing through the upper end F1 of the filter F. The communication holes 44 are not necessarily provided.

With the filter unit 30 according to the present embodiment, the partition 40 as described above is provided, thereby regulating movement of the bubble into the second chamber S12 by using the partition 40 even when the bubble having entered the first chamber S11 grows. Thus, contact of the bubble with the filter F can be avoided.

Figure 4:
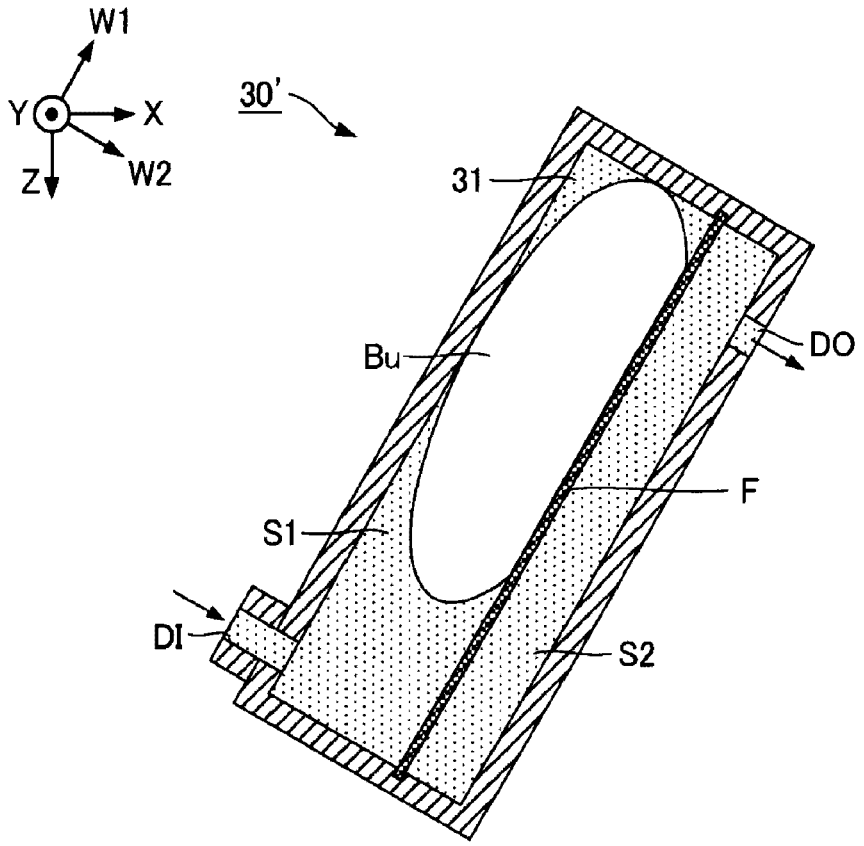
FIG. 4 is a sectional view illustrating the structure of a filter unit according to a comparative example.
Figure 5:
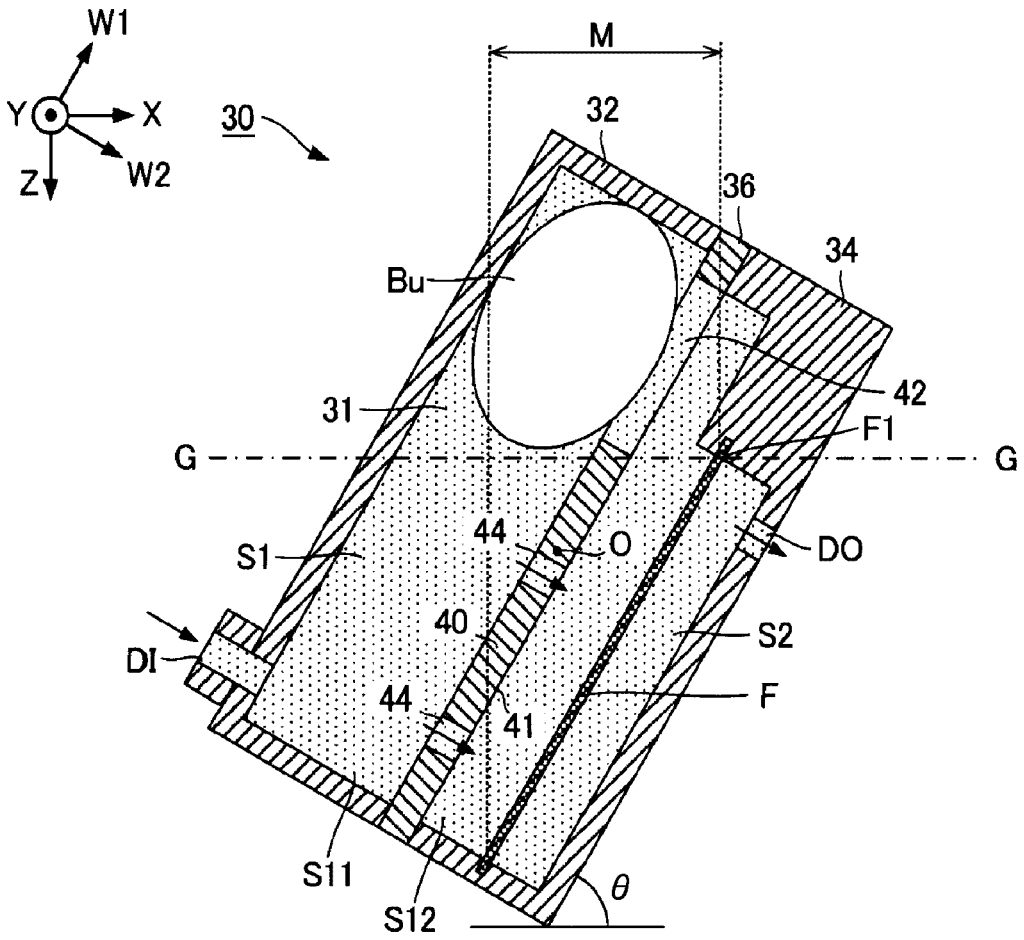
FIG. 5 illustrates operation of the filter unit according to the present embodiment during printing.
Figure 6:
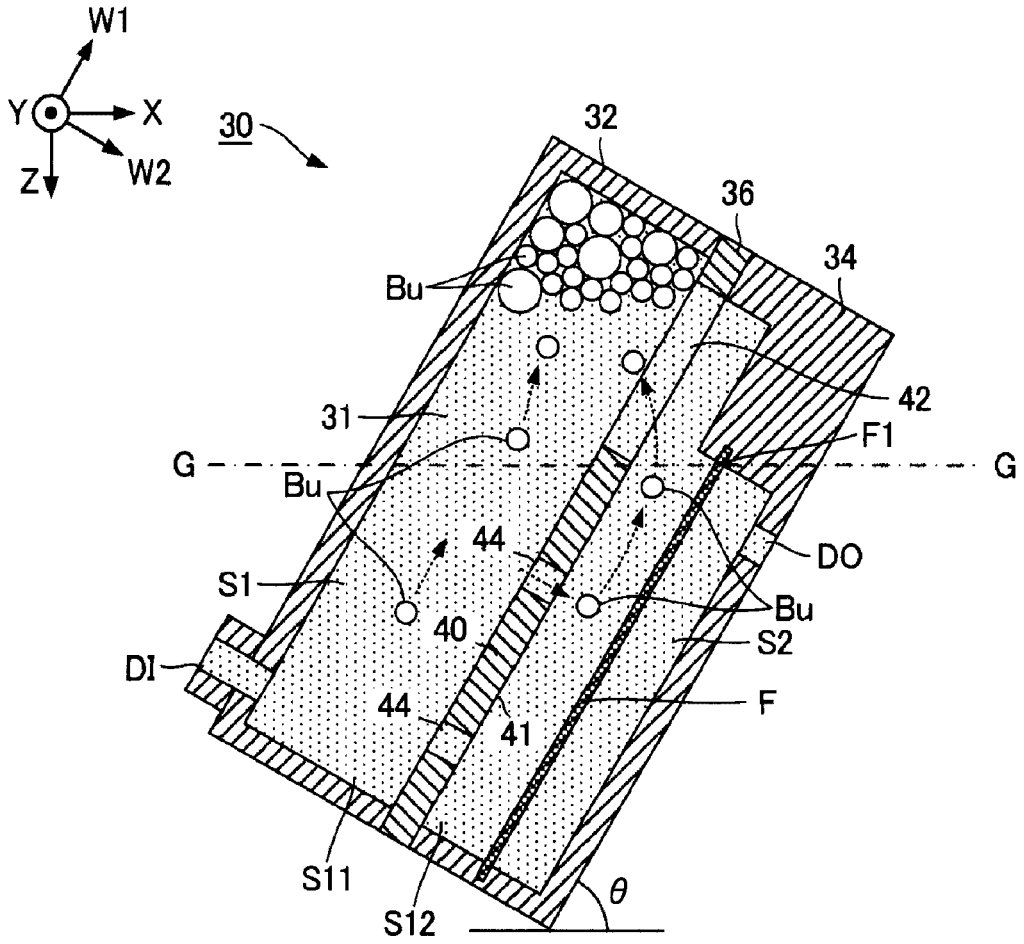
FIG. 6 illustrates operation of the filter unit according to the present embodiment during initial filling with ink.

Operation and effect of the filter unit 30 having such a structure are specifically described while comparing the filter unit 30 with a filter unit 30' according to a comparative example that does not includes the partition 40. FIG. 4 is a sectional view illustrating the structure of the filter unit 30' according to the comparative example. FIGS. 5 and 6 illustrate operation of the filter unit 30 according to the present embodiment including the partition 40. FIG. 5 illustrates operation during printing, and FIG. 6 illustrates operation during initial filling with the ink.

The filter unit 30' according to the comparative example illustrated in FIG. 4 has the structure in which the upstream chamber S1 and the downstream chamber S2 are separated from each other by the filter F. The filter unit 30' does not include the partition 40 in the upstream chamber S1. Thus, as illustrated in FIG. 4, when a bubble Bu having entered the upstream chamber S1 during printing grows, the bubble Bu is brought into contact with the filter F so as to close the surface of the filter F. This reduces the effective area of the filter F, thereby obstructing supply of the ink to the liquid discharge unit 22.

Even with the structure illustrated in FIG. 4, an increase in the volume of the upstream chamber S1 may allow the bubble Bu being a larger bubble to be stored in the upstream chamber S1 while reducing contact of the bubble Bu with the filter F. However, with the structure illustrated in FIG. 4, as the volume of the upstream chamber S1 is increased, flow of the ink pushing the bubble Bu downstream of the filter F is required more for discharging the bubble Bu. This reduces the performance for discharging the bubble Bu.

In contrast, the filter unit 30 according to the present embodiment illustrated in FIG. 5 includes the partition 40 that separates the upstream chamber S1 into the first chamber S11 and the second chamber S12 by the partition 40. This regulates movement of the bubble Bu to the second chamber S12 by using the partition 40 even when the bubble Bu having entered the first chamber S11 during the printing grows. Thus, contact of the bubble Bu with the filter F can be avoided. This can suppress the closing of the filter F with the bubble Bu, and accordingly, suppress a reduction of the effective area of the filter F caused by the bubble Bu.

Since such a bubble Bu is moved upward due to a buoyant force, the bubble Bu is likely to grow in an upper portion of the first chamber S11. In this regard, the filter unit 30 according to the present embodiment is provided with the opening 42, which allows communication between the first chamber S11 and the second chamber S12, in the upper portion of the partition 40. Thus, when the bubble Bu is discharged by suction from the outlet DO during cleaning, the bubble Bu stored in the upper portion of the first chamber S11 is likely to move to the second chamber S12 through the opening 42. Accordingly, the performance for discharging the bubble Bu can be improved. As has been described, according to the present embodiment, the bubble discharging performance can be improved while closing of the filter F with the bubble Bu having entered the filter chamber 31 can be suppressed. During the cleaning, for example, the bubble is discharged from the downstream chamber S2 by sucking the bubble Bu in the upstream chamber S1 from the downstream chamber S2 so as to cause the bubble Bu to pass through the filter F while a choke valve provided in the channel of the ink upstream of the filter unit 30 is closed so as to stop supply of the ink to the filter unit 30.

Furthermore, the partition 40 according to the present embodiment has the opening 42 disposed above the virtual horizontal plane G-G passing through the upper end F1 of the filter F. Thus, even when the bubble Bu stored above the virtual horizontal plane G-G in the first chamber S11 grows and becomes closer to the opening 42, contact of the bubble Bu with the filter F can be suppressed because the filter F is disposed below the bubble Bu. Furthermore, the partition 40 according to the present embodiment also has the plurality of communication holes 44, which allow communication between the first chamber S11 and the second chamber S12, disposed below the opening 42. Thus, even when the bubble Bu in the first chamber S11 grows to such a degree that the bubble Bu closes the opening 42 as illustrated in FIG. 5, the ink having been supplied to the first chamber S11 can move to the second chamber S12 through the communication holes 44 as indicated by arrows in FIG. 5. Thus, the ink can be supplied to the liquid discharge unit 22. Furthermore, since the communication holes 44 have a smaller opening area than that of the opening 42, the bubble Bu having grown in the first chamber S11 cannot pass through the communication holes 44. Thus, the movement of the bubble Bu to the second chamber S12 can be suppressed.

Furthermore, the communication holes 44 according to the present embodiment are disposed below the virtual horizontal plane G-G passing through the upper end F1 of the filter F. Thus, even when the bubble Bu grows above the virtual horizontal plane G-G in the first chamber S11, the communication holes 44 exist below the bubble Bu. Thus, the bubble Bu cannot pass through the communication holes 44, and accordingly, contact of the bubble Bu with the filter F can be suppressed. Furthermore, at least one of the plurality of communication holes 44 is disposed below a vertically central position O of the partition 40. In the example illustrated in FIG. 5, all the communication holes 44 are disposed below the central position O. According to the present embodiment, the vertically central position O of the partition 40 is the center of the plate-shaped member 36 included in the partition 40. With this structure, the flow of ink passing through the communication holes 44 is generated below the vertically central position O of the partition 40 in the first chamber S11. This can suppress stagnation of the ink in a vertically lower portion of the first chamber S11.

A pressure Pd (a pressure difference between the first chamber S11 and the second chamber S12) required to discharge the large bubble Bu from a hole can be given by the following expression 1:

$$Pd=(4\gamma\cdot\cos\theta d)/D1.$$

In the above-described expression 1, γ is the surface tension of the ink, θd is a contact angle of the ink formed between the direction W2 in which the hole is opened and the direction of γ, and D is the diameter of the hole. Thus, in order to discharge the large bubble Bu from the opening 42, it is sufficient that the pressure difference between the first chamber S11 and the second chamber S12 be larger than or equal to the Pd in the expression 1. Furthermore, in order not to discharge the large bubble Bu from the communication holes 44, it is sufficient that the pressure difference between the first chamber S11 and the second chamber S12 be smaller than the Pd in the expression 1.

As illustrated in FIG. 6, during the initial filling in which the liquid discharge head 20 is initially filled with the ink, the bubble Bu in the first chamber S11 breaks into small pieces in many cases. In such cases, small bubbles Bu stored in an upper portion of the first chamber S11 due to the buoyant force. The small bubbles Bu are combined with one another to grow into a large bubble Bu over time. Furthermore, as indicated by dotted arrows of FIG. 6, even when the small bubbles Bu pass through the communication holes 44 and move to the second chamber S12, the small bubbles Bu move upward in the second chamber S12 due to the buoyant force and return to the first chamber S11 through the opening 42. Thus, closing of the filter F with the bubbles Bu having passed through the communication holes 44 can be suppressed.

Such a partition 40 according to the present embodiment includes the plate-shaped member 36 and is disposed on the downstream substrate 34 to which the filter F is secured. Thus, the distance between the filter F and the wall surface 41 of the partition 40 can be adjusted depending on the thickness of the downstream substrate 34. The plate-shaped member 36 may be directly disposed on the downstream substrate 34. Alternatively, the plate-shaped member 36 may be indirectly disposed on the downstream substrate 34 by disposing the plate-shaped member 36 on a spacer disposed on the downstream substrate 34. This increases ease of adjusting the volume of the second chamber S12 between the filter F and the wall surface 41 of the partition 40.

Furthermore, as indicated by M of FIG. 5, part of the first chamber S11 is superposed on the filter F in the vertical direction according to the present embodiment. Thus, the size of the filter unit 30 can be reduced in a direction intersecting the vertical direction. Furthermore, since the first chamber S11 extends further upward than the filter F (above the virtual horizontal plane G-G), the volume of the first chamber S11 can be increased above the filter F. Thus, the amount of the bubbles Bu able to be stored in the first chamber S11 can be increased.

Figure 7:
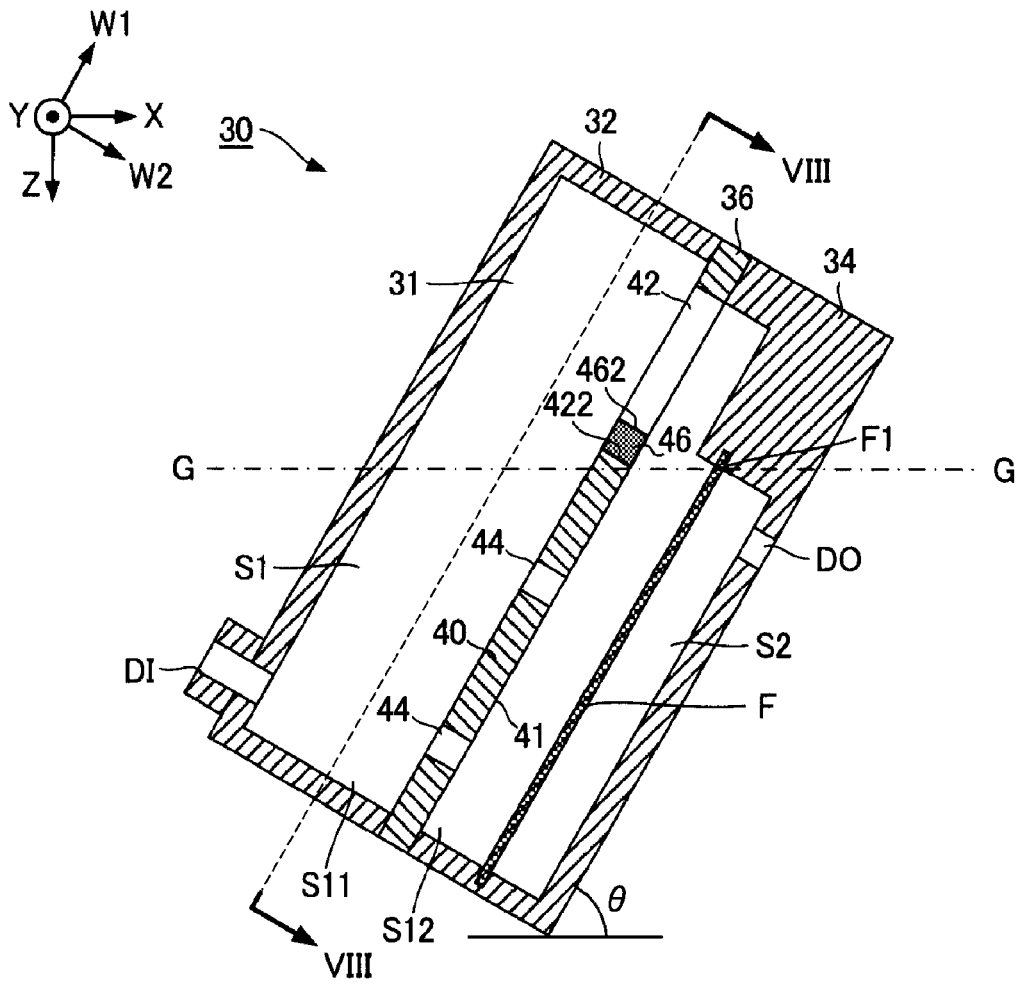
FIG. 7 is a sectional view of the filter unit according to a first variation of the first embodiment.
Figure 8:
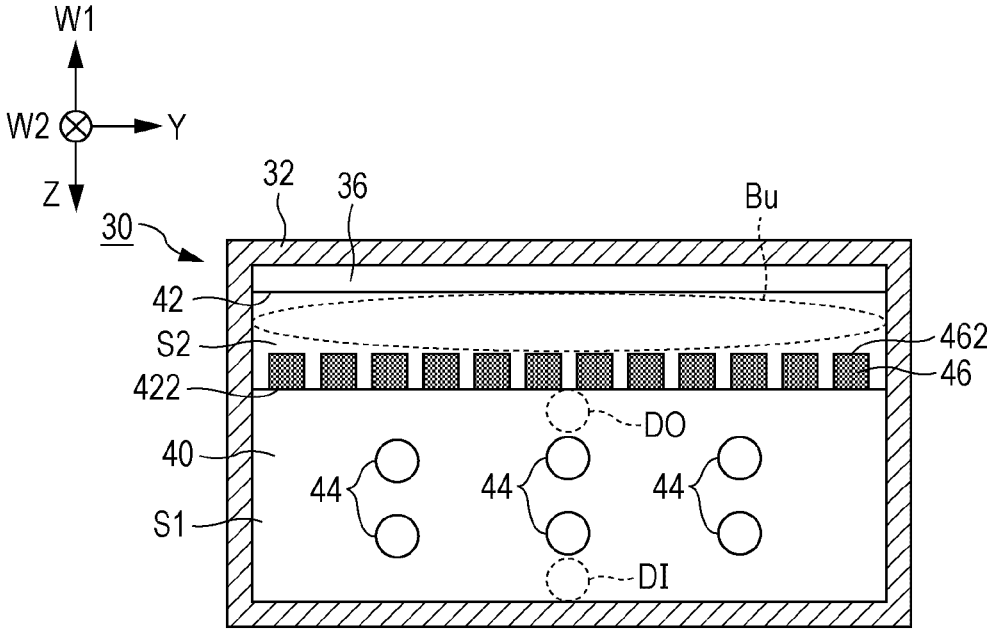
FIG. 8 is a sectional view taken along line VIII-VIII illustrated in FIG. 7.

A plurality of ribs that project at least in the vertical direction may be provided at a lower edge portion of the opening 42 of the partition 40 according to the present embodiment. FIGS. 7 and 8 are views of the structure of the filter unit 30 according to a first variation of the first embodiment, illustrating a specific example of the partition 40 provided with a plurality of ribs 46. FIG. 7 is a sectional view of the filter unit 30 according to the first variation, corresponding to FIG. 5. FIG. 8 is a sectional view taken along line VIII-VIII illustrated in FIG. 7. Referring to FIGS. 7 and 8, the plurality of ribs 46 are provided at a lower edge portion 422 of the opening 42 of the partition 40. The ribs 46 are space from one another in a direction (Y direction) intersecting the vertical direction.

With such a structure, as illustrated in FIG. 8, even when the bubble Bu grows and becomes closer to the opening 42 in the first chamber S11, the bubble Bu is pressed upward by upper ends 462 of the ribs 46. Thus, the ink supplied to the first chamber S11 can move into the second chamber S12 through gaps between the ribs 46, and accordingly, the ink can be supplied to the liquid discharge unit 22.

Figure 9:
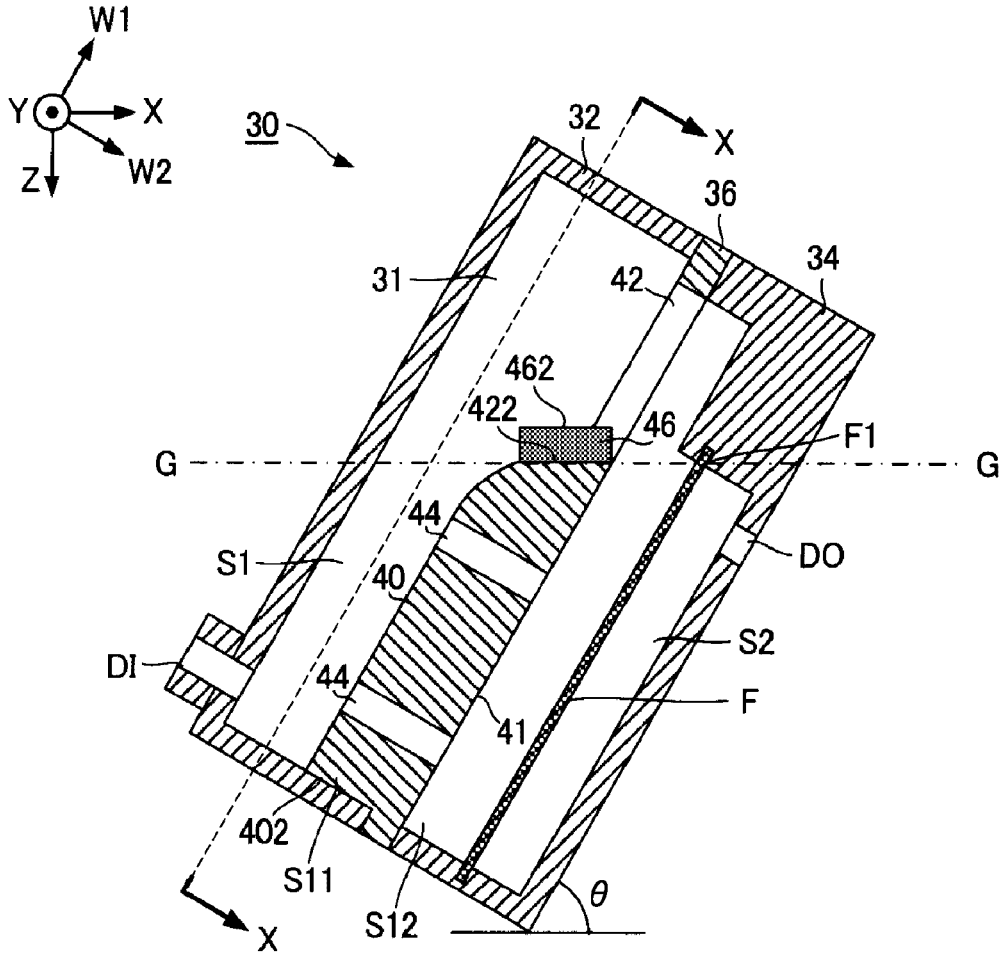
FIG. 9 is a sectional view of the filter unit according to a second variation of the first embodiment.
Figure 10:
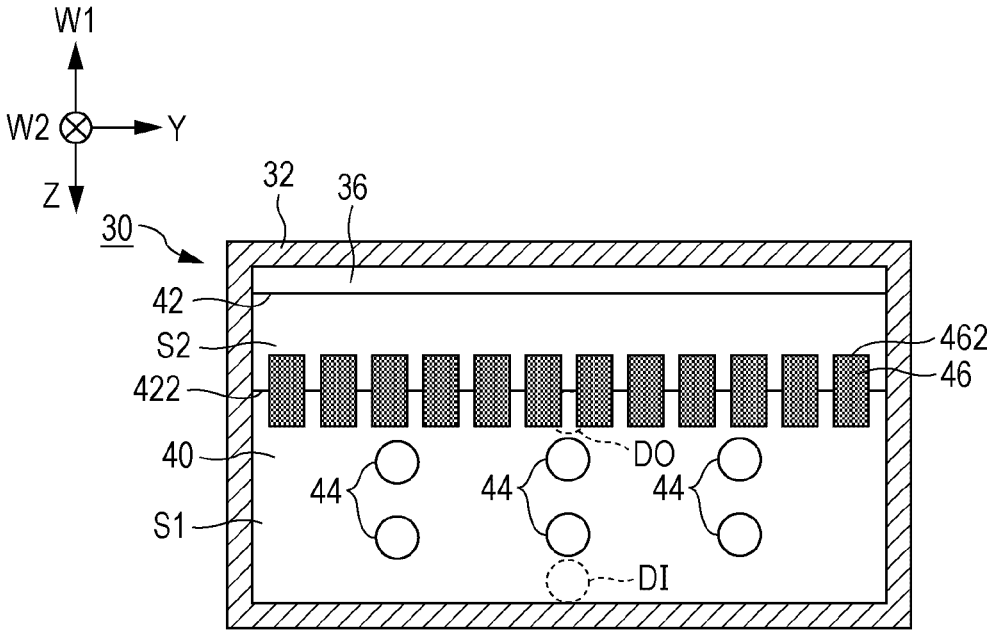
FIG. 10 is a sectional view taken along line X-X illustrated in FIG. 9.

FIGS. 9 and 10 are views of the structure of the filter unit 30 according to a second variation of the first embodiment, illustrating another specific example of the partition 40 provided with the plurality of ribs 46. FIG. 9 is a sectional view of the filter unit 30 according to the second variation, corresponding to FIG. 7. FIG. 10 is a sectional view taken along line X-X illustrated in FIG. 9. The thickness (thickness in the W2 direction) of the lower edge portion 422 of the opening 42 of FIG. 9 is larger than the thickness (thickness in the W2 direction) of the lower edge portion 422 of the partition 40 of FIG. 7. Thus, with the structure illustrated in FIG. 9, the ribs 46 that are larger than those of FIG. 7 in the thickness direction of the partition 40 can be provided.

With such a structure, the total area of the upper ends 462 of the plurality of ribs 46 pressing the bubble Bu upward in the first chamber S11 can be increased. Furthermore, as illustrated in FIG. 9, the lower edge portion 422 of the partition 40 is inclined so as to follow the virtual horizontal plane G-G. Thus, the ribs 46 can be disposed along the virtual horizontal plane G-G. This can increase the effect of vertically suppressing the bubble Bu having grown up to the virtual horizontal plane G-G.

Furthermore, the gaps between the ribs 46 that allow the ink to move from the first chamber S11 to the second chamber S12 can be increased in length in the thickness direction of the partition 40. Furthermore, with the structure illustrated in FIG. 9, the thickness of the partition 40 from a lower end 402 on the negative side in the W2 direction to the virtual horizontal plane G-G is larger than the thickness of the partition 40 illustrated in FIG. 7. Accordingly, a portion of the first chamber S11 above the virtual horizontal plane G-G can be larger in volume than a portion of the first chamber S11 below the virtual horizontal plane G-G. Thus, the bubble Bu having flowed from the inlet DI is likely to be guided toward the portion above the virtual horizontal plane G-G. Although an example in which the ribs 46 illustrated in FIGS. 7 to 10 are separately provided from the partition 40, this is not limiting. The ribs 46 may be integrated with the partition 40.

Figure 11:
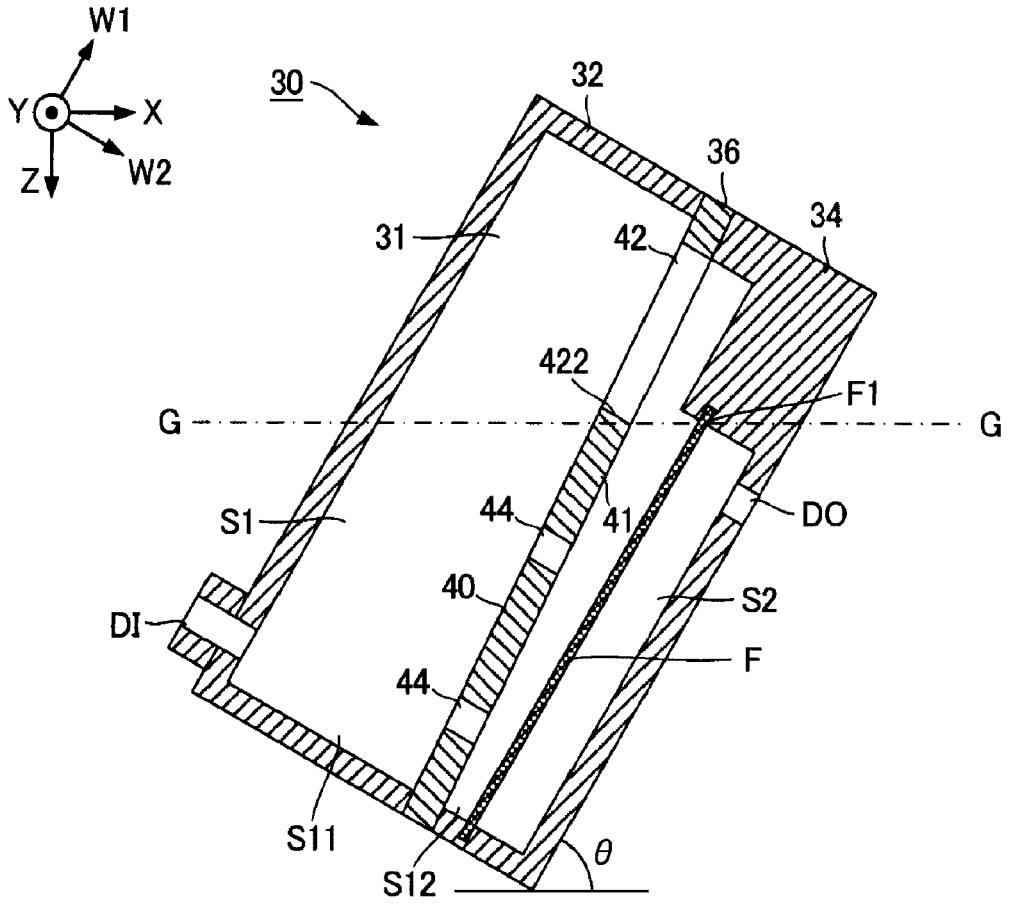
FIG. 11 is a sectional view of the filter unit according to a third variation of the first embodiment.
Figure 12:
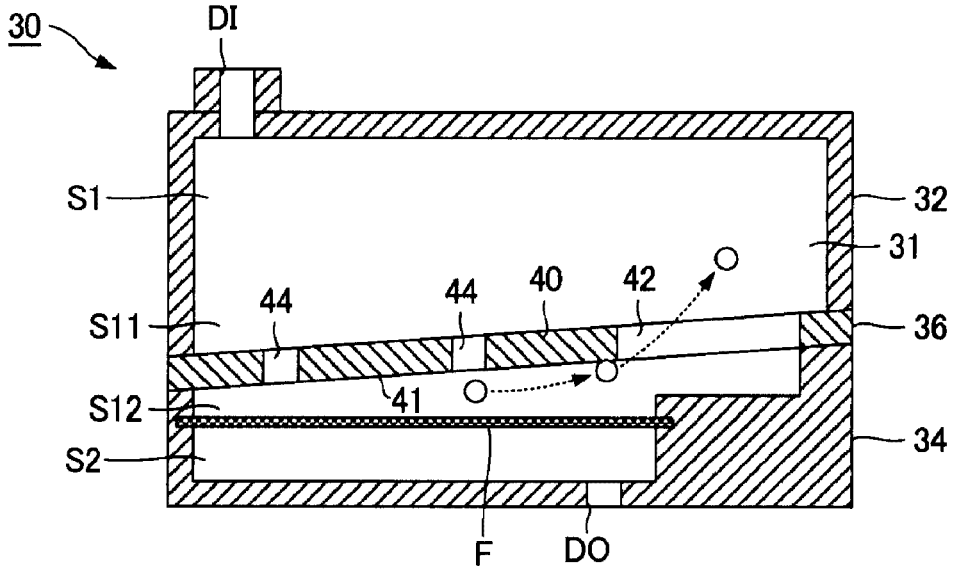
FIG. 12 is a sectional view illustrating a state in which the filter unit of FIG. 11 is horizontally disposed.

Although an example in which the wall surface 41 of the partition 40 facing the filter F is parallel to the surface of the filter F is described according to the above-described present embodiment, this is not limiting. The wall surface 41 of the partition 40 may be inclined relative to the surface of the filter F. FIGS. 11 and 12 illustrate the structure of the filter unit 30 according to a third variation of the first embodiment. FIG. 11 is a sectional view of the filter unit 30 according to the third variation, corresponding to FIG. 5. FIG. 12 is a sectional view illustrating a state in which the filter unit 30 of FIG. 11 is horizontally disposed. The wall surface 41 of the partition 40 facing the filter F illustrated in FIG. 11 is inclined relative to the filter F such that the distance between the wall surface 41 and the filter F increases toward the opening 42.

With this structure, as illustrated in FIG. 12, when the filter unit 30 is inclined such that the filter F is horizontally disposed during inspection or the like, the bubble Bu having entered the second chamber S12 can be guided to the opening 42 along the wall surface 41 of the partition 40 due to the buoyant force. Thus, the bubble Bu in the second chamber S12 can be easily moved to the first chamber S11 through the opening 42.

Second Embodiment

A second embodiment of the invention is described. In forms described as examples below, when operations or functions of elements are similar to those of the first embodiment, such elements are denoted by reference signs used in the description of the first embodiment, thereby appropriately omitting detailed description thereof. An example is described according to the second embodiment in which the effective area of the filter F is increased compared to that of the first embodiment.

Figure 13:
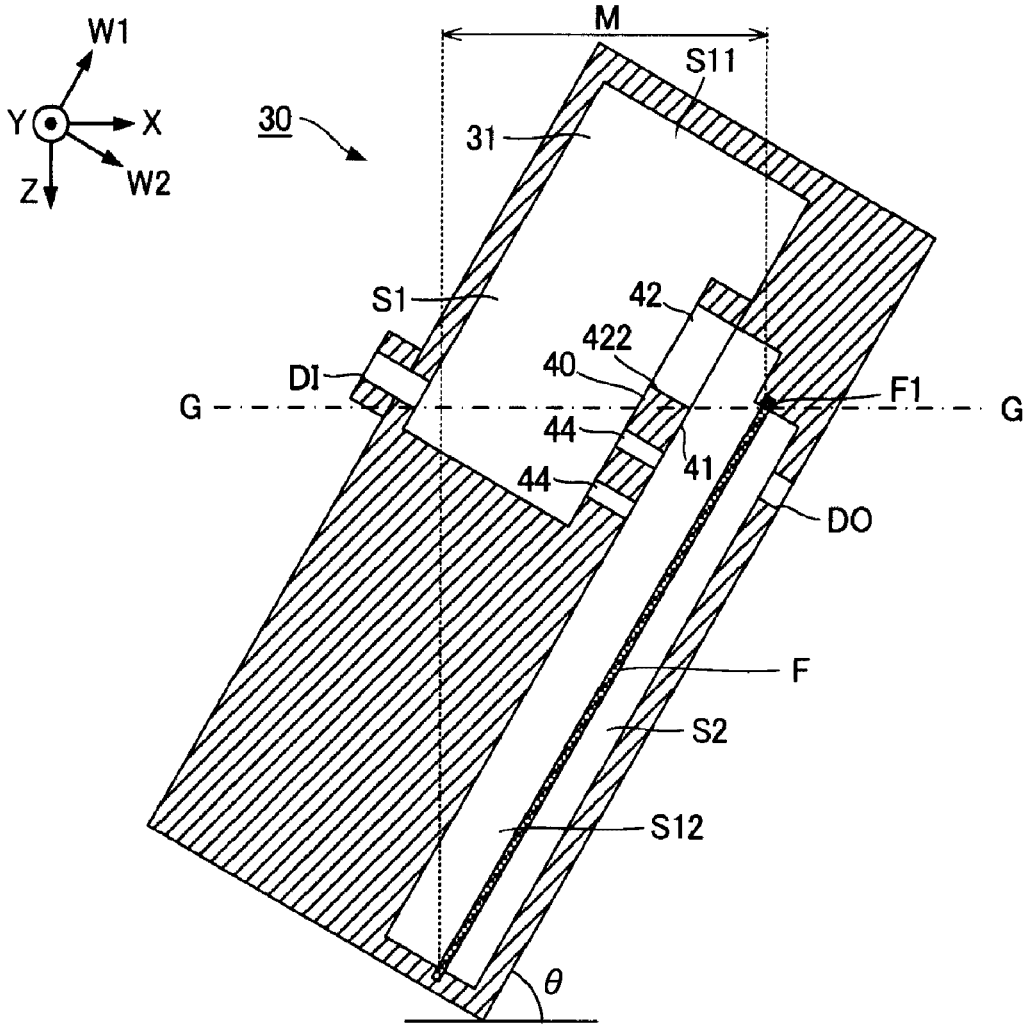
FIG. 13 is a sectional view illustrating the structure of the filter unit according to a second embodiment.
Figure 14:
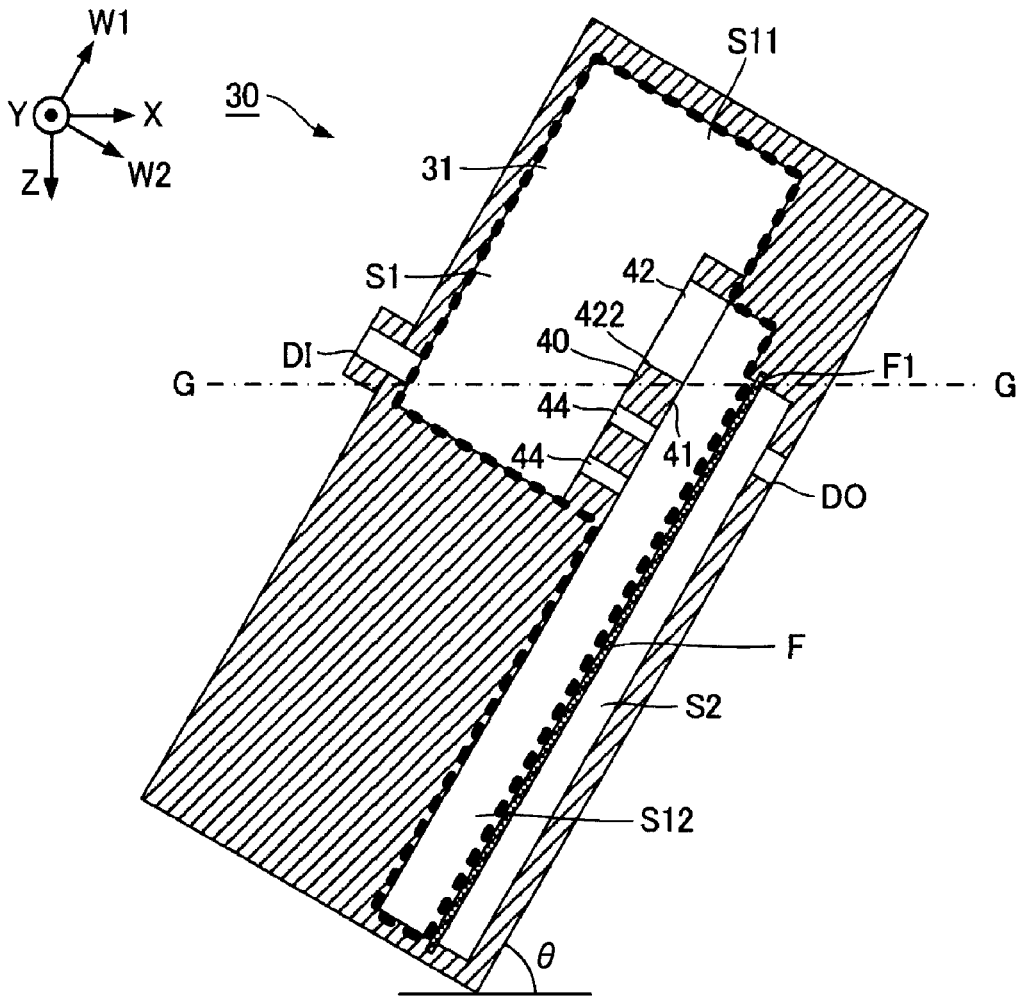
FIG. 14 illustrates operation of the filter unit of FIG. 13 during discharge of the ink.
Figure 15:
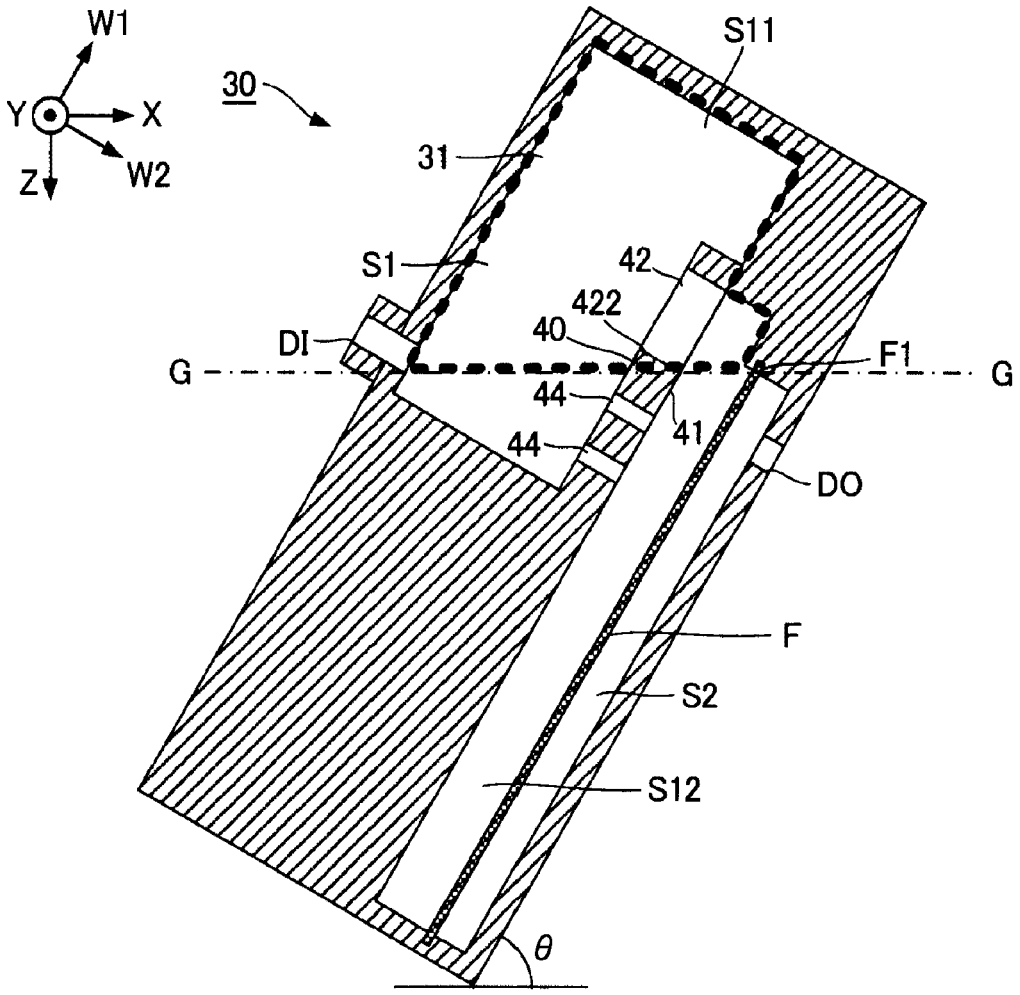
FIG. 15 illustrates operation of the filter unit of FIG. 13 during refilling with the ink.

FIG. 13 is a sectional view of the filter unit 30 according to the second embodiment, corresponding to FIG. 2. FIGS. 14 and 15 illustrate operation of the filter unit 30 according to the second embodiment. FIG. 14 illustrates operation during discharge of the ink, and FIG. 15 illustrates operation during refilling with the ink. The size of effective area of the filter F in the W1 direction is smaller than the size of the first chamber S11 in the W1 direction according to the first embodiment. In contrast, the size of effective area of the filter F in the W1 direction is larger than the size of the first chamber S11 in the W1 direction according to the second embodiment. Specifically, in the filter unit 30 illustrated in FIG. 13, the second chamber S12 is shifted relative to the first chamber S11 toward the negative side in the W1 direction, and the second chamber S12 and the downstream chamber S2 are extended toward the negative side in the W1 direction.

With this structure, the effective area of the filter F can be increased. With this structure, also, the portion of the first chamber S11 above the virtual horizontal plane G-G passing through the upper end F1 of the filter F can be increased in volume and a portion of the second chamber S12 below the virtual horizontal plane G-G can be reduced in volume. With this structure, the portion of the first chamber S11 out of a portion above the virtual horizontal plane G-G indicated by a dotted line in FIG. 15 (the portion of the first chamber S11 above the virtual horizontal plane G-G) can be larger than or equal to 50% of the entirety of the upstream chamber S1 indicated by a dotted line in FIG. 14 in volume.

In order to refill with the ink, first, the choke valve provided in the channel of the ink upstream of the filter unit 30 is closed so as to stop supply of the ink, and then, suction is performed from the downstream chamber S2 so as to reduce the pressure in the filter unit 30. Due to this pressure reduction, air (bubble) in the first chamber S11 of the filter unit 30 expands. Part of the expanding air moves beyond the virtual horizontal plane G-G, displaces the ink in the second chamber S12, and is discharged further in the downstream direction than the filter F. After that, the choke valve is opened to supply the ink, thereby the filter unit 30 is filled with the ink as illustrated in FIG. 15.

At this time, the air displaced in the upstream chamber S1 indicated by the dotted line in FIG. 14 contracts and becomes a bubble due to refilling with the ink. According to the present embodiment, the portion of the first chamber S11 above the virtual horizontal plane G-G is equal to or larger than 50% of the upstream chamber S1 in volume. With the structure as in the present embodiment, most of the bubble having contracted can be contained within the portion of the upstream chamber S1 above the virtual horizontal plane G-G indicated by the dotted line in FIG. 15. The bubble may remain in the portion of the upstream chamber S1 above the virtual horizontal plane G-G during refilling with the ink. Even in this case, since the filter F, which is disposed below the virtual horizontal plane G-G, is not closed by the bubble, the ink can be supplied to the liquid discharge unit 22.

With the structure illustrated in FIG. 13, as is the case with the structure illustrated in FIGS. 5 and 6, the movement of the bubble to the second chamber S12 is regulated by the partition 40 having the opening 42 and the communication holes 44. Thus, contact of the bubble with the filter F can be avoided, and the bubble discharging performance can be improved. Furthermore, with the structure illustrated in FIG. 13, part of the first chamber S11 is superposed on the filter F in the vertical direction according to the present embodiment as indicated by M of FIG. 13. Thus, the size of the filter unit 30 can be reduced in the direction intersecting the vertical direction. Furthermore, since the first chamber S11 extends further upward than the filter F (above the virtual horizontal plane G-G), the volume of the first chamber S11 can be increased above the filter F. Thus, the amount of the bubbles Bu able to be stored in the first chamber S11 can be increased.

Figure 16:
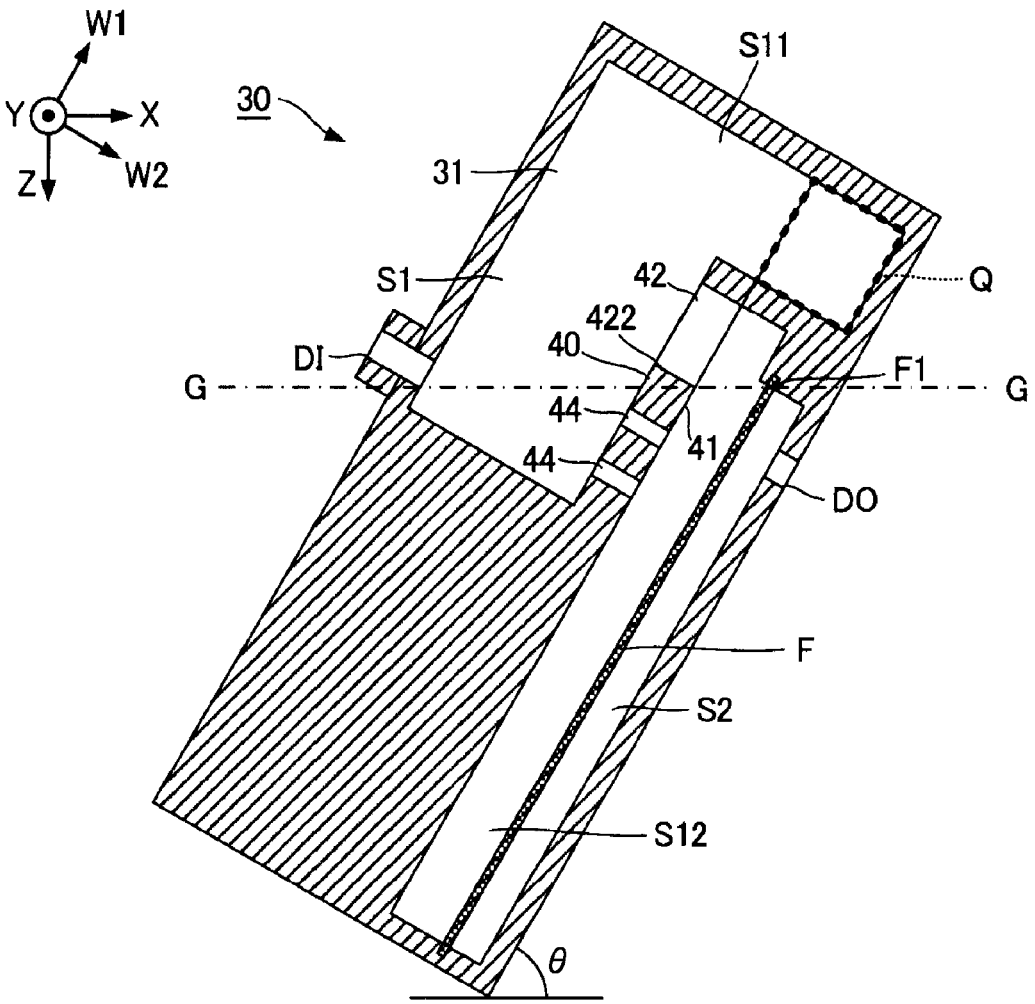
FIG. 16 is a sectional view of the filter unit according to a first variation of the second embodiment.

With the structure illustrated in FIG. 13, the second chamber S12 is shifted relative to the first chamber S11 toward the negative side in the W1 direction. Thus, there exists an unused space in the W1 direction existing higher than the second chamber S12 and the filter F on the downstream chamber S2 side in the vertical direction. Accordingly, with the structure illustrated in FIG. 13, in the vertically higher portion than the filter F, the first chamber S11 can be extended in the W2 direction so as to intersect a plane including an in-plane of the filter F. For example, the filter unit 30 illustrated in FIG. 16 according to a first variation of the second embodiment, the first chamber S11 is extended in the W2 direction. With the structure illustrated in FIG. 16, compared to the structure illustrated in FIG. 13, the volume of the first chamber S11 can be increased by the area of a Q portion (surrounded by a dotted line in FIG. 16) disposed vertically higher than the filter F. The plate-shaped member 36 of the partition 40, the upstream substrate 32, and the downstream chamber S2 are separately formed in the structure as illustrated in FIG. 2. In FIGS. 13 and 16, unlike the structure as illustrated in FIG. 2, these elements are integrally formed. However, these elements may be separately formed and disposed one on top of another for the structure illustrated in FIGS. 13 and 16.

Figure 17:
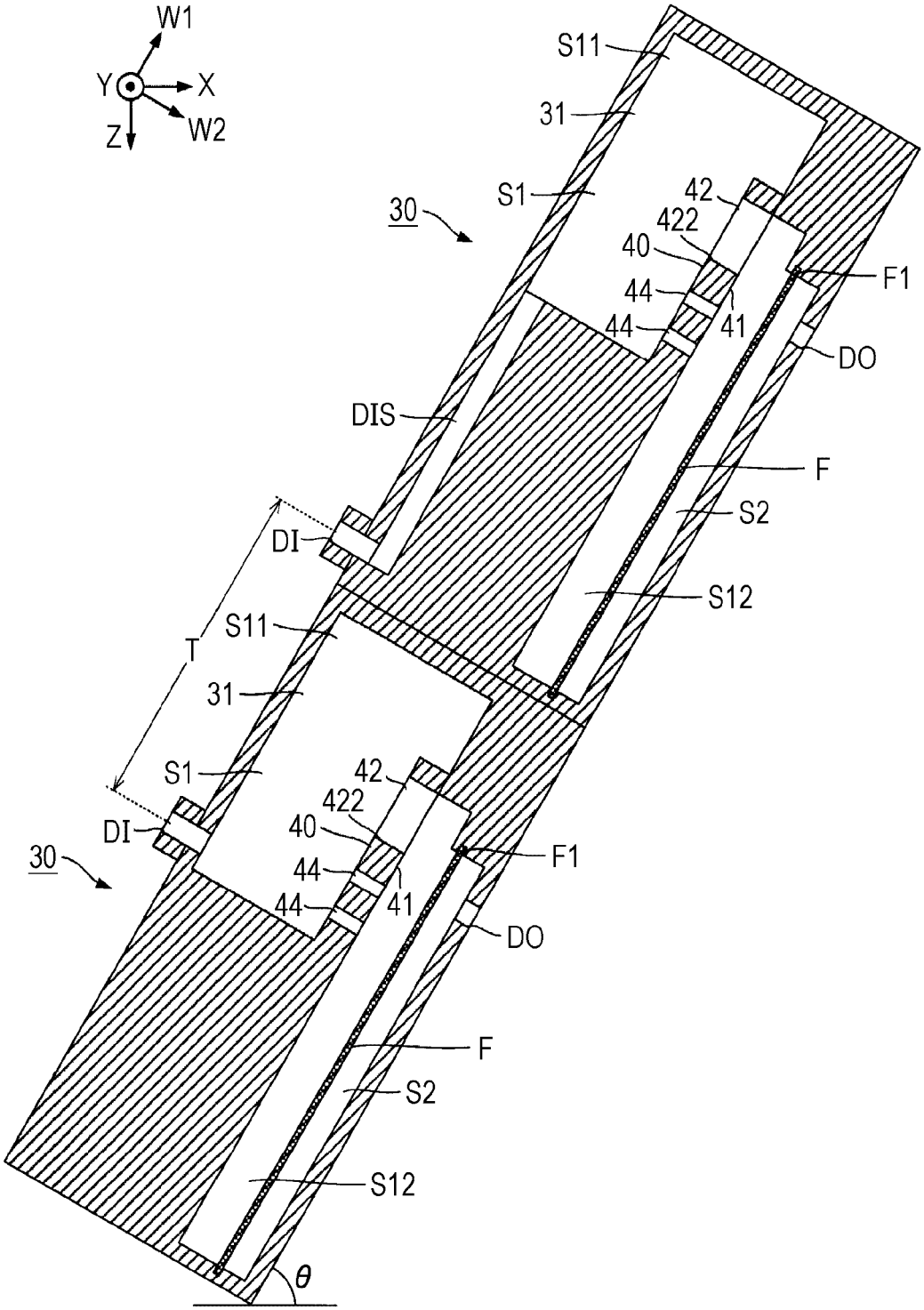
FIG. 17 is a sectional view of the filter unit according to a second variation of the second embodiment.

Furthermore, two or more of the filter unit 30 illustrated in FIG. 13 may be combined with each other. For example, according to a second variation of the second embodiment illustrated in FIG. 17, two of the filter unit 30 illustrated in FIG. 13 are arranged in the W1 direction. In this case, when the structure of the filter unit 30 illustrated in FIG. 13 is unchanged and two of the unchanged filter unit 30 are arranged in the W1 direction, there is a large distance between the inlet DI of one of the filter units 30 and that of the other filter unit 30. In order to address this, with the structure illustrated in FIG. 17, an extension channel DIS is provided. The extension channel DIS allows one of the inlets DI (the inlet of the filter unit 30 on the positive side in the W1 direction) to extend toward the other inlet DI (the inlet of the filter unit 30 on the negative side in the W1 direction). With this structure, as illustrated in FIG. 17, a distance T between the inlets DI can be reduced. Thus, for example, the size of a component to be disposed upstream of each inlet DI (component to be connected to the inlet DI) can be reduced.

Although the filter unit 30 inclined by 60 degrees relative to the horizontal direction is described in the example according to the above-described embodiments, the inclination angle θ by which the filter unit 30 is inclined relative to the horizontal direction is preferably in a range of $0<\theta<90$.

However, the inclination angle θ of the filter unit 30 may be 0 degree (horizontal disposition) or 90 degree (vertical disposition).

Variations

The exemplified forms and the embodiments having been described can be varied in a variety of manners. Specific forms of variations are exemplified as follows. Two or more of the forms arbitrarily selected from among the following examples and the above-described forms can be appropriately combined as long as no conflict occurs between the selected two or more forms.

1. Although a serial scan head for which the carriage 18 on which the liquid discharge head 20 is mounted repeatedly reciprocates in the X direction has been described as the example according to the above-described embodiments, the invention can be applied also to a line scan head in which liquid discharge heads 20 are arranged throughout the width of the medium 11.

2. Although the liquid discharge head 20 of a piezoelectric method that utilizes piezoelectric elements applying mechanical vibration to pressure chambers is described as the example according to the above-described embodiments, a liquid discharge head of a thermal method that utilizes heating elements generating bubbles in pressure chambers by heating may be used.

3. The liquid discharge apparatus 10 described as the example according to the above-described embodiments can be used for any of a variety of apparatuses such as facsimile machines and copiers other than apparatuses dedicated to printing. Furthermore, application of the liquid discharge apparatus 10 according to the invention is not limited to printing. For example, a liquid discharge apparatus that discharges a solution of colorant is used as any of manufacturing apparatuses that form color filters of liquid crystal displays, organic electroluminescent (EL) displays, field-emission displays (FEDs) and so forth. Furthermore, a liquid discharge apparatus that discharges a solution of a conductive material is used as any of manufacturing apparatuses that form wiring and electrodes of wiring substrates. Furthermore, a liquid discharge apparatus is used as any of chip manufacturing apparatuses that discharge solutions of biological organic matter as a type of liquid.

The entire disclosure of Japanese Patent Application No: 2018-008095, filed Jan. 22, 2018, is expressly incorporated by reference herein in its entirety.

What is claimed is:

1. A filter unit comprising:

a filter chamber disposed in a channel through which liquid is to be supplied to a liquid discharge unit, the filter chamber being inclined relative to a horizontal direction;

a filter disposed in the filter chamber, the filter being inclined relative to the horizontal direction and separating the filter chamber into an upstream chamber the liquid to be supplied to and a downstream chamber in communication with the liquid discharge unit; and a partition that has a wall surface facing the filter and that separates the upstream chamber into a first chamber the liquid to be supplied to and a second chamber adjacent to the filter, wherein the filter unit has, in an upper portion of the partition, an opening that allows communication between the first chamber and the second chamber.

2. The filter unit according to claim 1, wherein the opening of the partition is disposed above a virtual horizontal plane passing through an upper edge of the filter.

3. The filter unit according to claim 2, wherein the partition has at least one communication hole that allows communication between the first chamber and the second chamber, and wherein the at least one communication hole is disposed below the opening and has a smaller opening area than that of the opening.

4. The filter unit according to claim 3, wherein the at least one communication hole is disposed below a virtual horizontal plane passing through an upper edge of the filter.

5. The filter unit according to claim 3, wherein the at least one communication hole includes a plurality of communication holes, and wherein at least one of the plurality of communication holes is disposed below a central position of the partition in a vertical direction.

6. The filter unit according to claim 1, further comprising:

a plurality of ribs that project at least in a vertical direction at a lower edge portion of the opening of the partition, wherein the plurality of ribs are space from one another in a direction intersecting the vertical direction.

7. The filter unit according to claim 1, wherein, a portion of the first chamber disposed above a virtual horizontal plane passing through an upper edge of the filter is larger than or equal to 50% of an entirety of the upstream chamber in volume.

8. The filter unit according to claim 1, wherein part of the first chamber is superposed on the filter in a vertical direction.

9. The filter unit according to claim 1, wherein the first chamber extends further upward than the filter.

10. The filter unit according to claim 1, wherein the wall surface of the partition facing the filter is inclined relative to the filter such that a distance between the wall surface and the filter increases toward the opening.

11. The filter unit according to claim 1, wherein the partition is a plate-shaped member disposed on a substrate to which the filter is secured.

12. The filter unit according to claim 11, wherein part of the first chamber is superposed on the filter in a vertical direction.

13. A liquid discharge apparatus, comprising:

the filter unit according to claim 1; and the liquid discharge unit that includes a nozzle which discharges the liquid supplied to the liquid discharge unit through the filter unit.

14. A liquid discharge apparatus, comprising:

the filter unit according to claim 2; and the liquid discharge unit that includes a nozzle which discharges the liquid supplied to the liquid discharge unit through the filter unit.

15. The filter unit according to claim 1, wherein the partition has at least one communication hole that allows communication between the first chamber and the second chamber, and wherein the at least one communication hole is disposed below the opening and has a smaller opening area than that of the opening.

16. The filter unit according to claim 2, further comprising:

a plurality of ribs that project at least in a vertical direction at a lower edge portion of the opening of the partition, wherein the plurality of ribs are space from one another in a direction intersecting the vertical direction.

17. The filter unit according to claim 2, wherein, a portion of the first chamber disposed above a virtual horizontal plane passing through an upper edge of the filter is larger than or equal to 50% of an entirety of the upstream chamber in volume.

18. The filter unit according to claim 2, wherein part of the first chamber is superposed on the filter in a vertical direction.

19. The filter unit according to claim 2, wherein the partition is a plate-shaped member disposed on a substrate to which the filter is secured.

20. The liquid discharge apparatus according to claim 13, wherein two of the filter unit are arranged, and the two filter units each has an inlet through which the liquid is supplied thereto, and wherein an extension channel is provided so as to extend the inlet of one of the two filter units toward the inlet of another of the filter units.

* * * * *